US008759407B2

(12) United States Patent
Walter

(10) Patent No.: US 8,759,407 B2
(45) Date of Patent: Jun. 24, 2014

(54) METHOD FOR PRODUCING SYNTHETIC NATURAL GAS

(75) Inventor: Stefan Walter, Frankfurt a. M. (DE)

(73) Assignee: Lurgi GmbH, Frankfurt am Main (DE)

( * ) Notice: Subject to any disclaimer, the term of this patent is extended or adjusted under 35 U.S.C. 154(b) by 0 days.

(21) Appl. No.: 13/812,982

(22) PCT Filed: Jun. 15, 2011

(86) PCT No.: PCT/EP2011/002939
§ 371 (c)(1),
(2), (4) Date: Feb. 28, 2013

(87) PCT Pub. No.: WO2012/013266
PCT Pub. Date: Feb. 2, 2012

(65) Prior Publication Data

US 2013/0178546 A1 Jul. 11, 2013

(30) Foreign Application Priority Data

Jul. 29, 2010 (DE) ..... 10 2010 032 709

(51) Int. Cl.
*C07C 27/00* (2006.01)

(52) U.S. Cl.
USPC ..... 518/706; 518/700; 518/705

(58) Field of Classification Search
USPC ..... 518/700, 705, 706
See application file for complete search history.

(56) References Cited

U.S. PATENT DOCUMENTS

| | | | |
|---|---|---|---|
| 3,928,000 | A | 12/1975 | Child et al. |
| 4,005,996 | A | 2/1977 | Hausberger et al. |
| 4,124,628 | A | 11/1978 | McRobbie |
| 2009/0247653 | A1 | 10/2009 | Ravikumar et al. |

FOREIGN PATENT DOCUMENTS

| | | | |
|---|---|---|---|
| EP | 0 120 590 | A1 | 10/1984 |
| WO | 2007/117597 | A2 | 10/2007 |

OTHER PUBLICATIONS

International Search Report Dated Nov. 29, 2011, Mailed Dec. 9, 2011.
English Translation of International Search Report Dated Nov. 29, 2011, Mailed Dec. 9, 2011.

*Primary Examiner* — Jafar Parsa
(74) *Attorney, Agent, or Firm* — Norris McLaughlin & Marcus PA

(57) ABSTRACT

Process for producing synthetic natural gas (SNG) which is provided in an energy-efficient way at the inlet pressure into a downstream pipeline system. For this purpose, a synthesis gas containing carbon oxides and hydrogen is converted into a product gas rich in methane by multi-stage catalytic methanation in a main reaction zone and a post-reaction zone, wherein the adjustment of the target pressure is effected by compression before the main reaction zone and/or before or in the post-reaction zone.

10 Claims, 3 Drawing Sheets

METHOD FOR PRODUCING SYNTHETIC NATURAL GAS

This is a 371 of PCT/EP2011/002939, filed Jun. 15, 2011 (international filing date), claim priority of German application 10 2010 032 709.3, filed Jul. 29, 2010.

This invention relates to a process for producing synthetic natural gas. In particular, the invention relates to a process for producing and providing synthetic natural gas at pressures which are suitable for directly feeding into natural gas pipelines.

BACKGROUND OF THE INVENTION

Due to the doubts about the availability of and the supply with natural gas in the 1970s, considerable efforts were made to generate synthetic natural gas (substitute natural gas, SNG) proceeding from the large coal reserves known. This was discussed in particular everywhere where there was a large local demand of natural gas as important primary energy carrier and at the same time considerable coal reserves were available locally. The main constituent of SNG—like also in natural gas—is methane. As coal-based plants for generating SNG require a comparatively high investment, and subsequently large new natural gas reserves were discovered, which gave reason to hope for a long-term supply with inexpensive natural gas, the interest in the industrial generation of SNG initially declined again in the time following.

As the situation has changed to the effect that the end of the natural gas reserves known so far also is foreseeable, the interest in the methanation as an alternative source for natural-gas substitute gas has increased again in the recent past. In addition, the technology offers a possibility for utilizing large and remote coal reserves more efficiently. Geopolitical considerations also give rise to the desire to achieve greater independence of the comparatively few large natural gas reserves. The generation of SNG on an industrial scale therefore again meets with an increased interest. It is particularly advantageous that the infrastructure established for the supply with natural gas, for example already existing pipeline systems, can further be utilized practically unchanged.

As is explained in Ullmann's Encyclopedia of Industrial Chemistry, Sixth Edition, 1998 Electronic Release, keyword "Gas Production", the principle of the catalytic methane synthesis by hydrogenation of carbon monoxide (CO) with hydrogen ($H_2$) dates back to papers by Sabatier and Senderens from the year 1902. The reaction can be described by the following reaction equation:

$$CO+3H_2=CH_4+H_2O$$

Carbon dioxide also can be converted to methane according to the equation $$CO_2+4H_2=CH_4+2H_2O$$

Both reactions are connected with each other via the CO conversion reaction (CO shift), which in the presence of active catalysts always proceeds simultaneously:

$$CO+H_2O=CO_2+H_2$$

Both of said reactions for the formation of methane proceed strongly exothermally and with a decrease in volume. The formation of methane in a high yield according to the above reactions therefore is promoted at low temperatures and high pressures. To achieve acceptable reaction rates, the use of suitable catalysts then is required. Therefore, catalysts are used which are based on nickel as active metal component. The presence of catalyst poisons, such as for example sulfur-containing components, must carefully be avoided, since the deactivation of the catalysts used primarily depends on the presence of such catalyst poisons. Typical nickel-based methanation catalysts operate at temperatures of 300 to 700° C.; there are used for example catalysts with a high nickel content on special alumina carrier materials, which were stabilized by doping with zirconia.

Technical methods for producing SNG on an industrial scale proceeding from synthesis gas containing carbon monoxide and hydrogen have long since been known to the experts. For example, the U.S. patent specification U.S. Pat. No. 4,005,996 A teaches a method for increasing the energy content of a synthesis gas stream obtained by gasification of coal. The method includes the catalytic methanation of carbon oxides with hydrogen by means of highly active nickel catalysts, wherein a gas mixture containing methane and steam is generated in several reaction stages. The synthesis gas product of the gasification of coal initially is liberated from catalyst poisons and other impurities as well as a part of the contained carbon dioxide by gas scrubbing with suitable absorbents, for example methanol or absorbents containing amine. Depending on the composition of the primary gas from the gasification of coal, further conditioning stages, for example adsorption stages for removing sulfur-containing components on adsorbents containing zinc oxide, and additional conversion stages such as shift reactors are passed through for adjusting the hydrogen and CO content of the synthesis gas. The purified and conditioned synthesis gas then is heated up to the inlet temperature into the first methanation reactor of roughly 260° C. by heat exchange against recirculated product gas of the first methanation stage. The reactor pressure is about 25 bar(a). By admixing the recirculation gas to the fresh feed gas of the methanation, the gas composition also is changed advantageously such that in the catalyst bed and at the reactor outlet of the methanation no more deposition of solid carbon will occur. In addition, the recirculation of product gas serves for mastering the heat tonality due to the high exothermicity of the above-mentioned reactions. The first reaction stage of the methanation is followed by a further methanation stage, which is operated without product gas recirculation. The product gas of the methanation, which is enriched in terms of its methane content and thus its energy content, is cooled and dried and thus has a quality which is suitable for introduction or admixture into conventional natural gas pipelines. For introduction into a natural gas pipeline, the gas pressure of the SNG must be increased to the pipeline operating pressure by means of compression in a pipeline head station, which pressure can be up to 80 bar(a) according to Ullmann's Encyclopedia of Industrial Chemistry, Sixth Edition, 1998 Electronic Release, keyword "Natural Gas", Chapter 4.1.1 "Pipeline Transmission".

A more modern process variant for recovering SNG from synthesis gas is disclosed in the US patent application US 2009/0247653 A1. FIG. 2 of this document shows a process in which the synthesis gas initially passes through one or more methanation reactors, wherein a primary methanation product gas is generated, which subsequently is cooled, in order to separate water from the primary methanation product gas by condensation. A part of the methanation primary product dried in this way subsequently is recirculated as recirculation gas before the entrance to the methanation reactors. The remaining part of the primary methanation product gas is supplied as feed to a further adiabatic methanation reactor ("trim reactor"). Preferably, the process is carried out such that at least two series-connected primary methanation reactors are present, wherein the first reactor is charged with fresh synthesis-gas feed gas and the recirculation stream, and to the second reactor both the product gas of the first reactor and fresh synthesis-gas feed gas is supplied. In this process, too, a cooled and dried methanation product gas finally is obtained, whose pressure must be increased before its discharge into a pipeline network.

For transport to consumers, the SNG produced by means of methanation often is to be fed into an existing pipeline system. Due to the pressure loss suffered by the synthesis gas when passing through the methanation plant, and due to the lower pressure level in the methanation plant as compared to the pipeline pressure, it is required to compress the product gas rich in methane to pipeline pressure after the methanation plant. In the brochure "From solid fuels to substitute natural gas (SNG) using TREMP™", available in the Internet under the web address www.topsoe.com, it is stated that it is frequently necessary to increase the pressure of the SNG produced before feeding the same into a pipeline system. Furthermore, it is stated that the pressure increase is effected after the production and drying of the SNG produced, i.e. directly before feeding the same into the pipeline.

SUMMARY OF THE INVENTION

It is the object underlying the present invention to provide a process for producing SNG from synthesis gas on an industrial scale and for subsequently feeding the SNG produced into a pipeline system, which is characterized by a particular energy efficiency.

The solution of the object according to the invention substantially can be derived from the characterizing features of claim 1 in conjunction with the features of the generic part. Further advantageous aspects of the invention can be taken from the sub-claims.

In the processes for producing SNG and feeding the same into a pipeline system, which are known in the prior art, the adaptation of the target pressure of the product gas of the ethanetion, i.e. in general the pipeline pressure, is effected after the last reaction stage, as well as after cooling and drying the product gas.

Surprisingly, it has now been found that considerable energy savings can be achieved when the adjustment of the target pressure is effected by means of compression already before the main reaction zone and/or before or in the post-reaction zone This is not obvious in so far as the pressure to be adjusted there is obtained as sum of the target pressure and the pressure loss over the entire or the remaining methanation plant. The latter is not known a priori; the skilled person therefore will avoid to adjust a target pressure at an upstream point, when plant sections generating a pressure loss still are interposed, but will prefer the adjustment of the target pressure as close as possible to the transfer point (here at the entrance to the pipeline).

In a methanation process according to the prior art, the product gas rich in methane must be compressed after the methanation plant from a lower pressure to the pipeline pressure due to the expansion via the plant sections. Due to the higher pressure ratio, defined as ratio of outlet pressure to inlet pressure of the compressor, more energy must employed for the product compressor and for the cycle compressor together as compared to the process according to the invention.

It is the subject-matter of the process according to the invention that compressing the synthesis gas for adjusting the target pressure is effected before the main reaction zone and/or before or in the post-reaction zone, and not—like in the prior art processes—only after the methanation plant. The temperature increase as a result of the compression thereby is utilized for heating up the synthesis gas, which explains the energetic advantages of the process. It is also advantageous that in the process according to the invention a colder synthesis gas is compressed in the additional compressor as compared to the cycle compressor, and that a more favorable pressure ratio is obtained both for the cycle compressor and for the additional compressor. These advantages make up for the apparent disadvantage that a larger mass flow is compressed. The result is that the sum of the compression energy for additional, cycle and product compressor is lower with this circuitry. When the additional compressor is arranged before or in the post-reaction zone, the utilization of the lower pressure ratio leads to the energetic advantages of the process according to the invention. An arrangement in the post-reaction zone can be effected when the same comprises several reactors. In this case, the arrangement of the additional compressor before the last reactor of the post-reaction zone was found to be particularly favorable. Before introduction into the pipeline system, the SNG product gas possibly must be supplied to cooling and drying, as it is also provided in the prior art.

DETAILED DESCRIPTION

Particularly preferably, the adjustment of the target pressure is effected by compression before the main reaction zone and before combining the synthesis-gas fresh gas stream with the recirculation stream. For this purpose, an additional compressor is arranged before the point of combining the synthesis-gas fresh gas stream with the recirculation stream. The same for example can be provided downstream of the usually present fine desulfurization stage. Since the synthesis-gas fresh gas stream leaving the fine desulfurization stage is comparatively cold, a part of the supplied compression energy advantageously can be used for preheating the synthesis-gas fresh gas stream. In addition, the cycle compressor is relieved. In this aspect of the invention, particularly great energy savings are achieved, as will be demonstrated by the following numerical examples. In this and the subsequently described aspects of the invention, a final compression of the product gas of the methanation plant in a product compressor possibly can be omitted completely. When it is advantageous to use a product compressor, the same can be dimensioned considerably smaller in terms of its compressor capacity as compared to a methanation plant according to the prior art.

In a further, preferred aspect the adjustment of the target pressure is effected by compression before or in the post-reaction zone, namely after withdrawing the recirculation stream after the main reaction zone. The additional compressor can be provided upstream of the cooler prior to entry into the post-reaction zone; in this case, a part of the supplied compression energy advantageously is utilized for steam generation. Particularly preferably, however, it is provided downstream of the cooler, since then a colder and drier gas can be compressed. Alternatively, the additional compressor also can be provided directly before the first catalyst bed of the post-reaction zone, whereby like in the above case a part of the supplied compression energy can be utilized for preheating the gas stream entering into the post-reaction zone. An arrangement of the additional compressor in the post-reaction zone also is possible, when the same comprises several reactors. In this case, the arrangement of the additional compressor before the last reactor of the post-reaction zone was found to be particularly favorable.

A preferred aspect of the invention provides that heating up the synthesis-gas feed stream supplied to the main reaction zone is effected by indirect heat exchange against a hot fluid stream inherent or foreign to the process. Particularly preferably, heating up the synthesis-gas feed stream supplied to the main reaction zone is effected by indirect heat exchange against the recirculation stream. The heat integration obtained in this way contributes to the energy efficiency of the process according to the invention.

The admixture of the recirculation stream to the synthesis gas fresh gas stream furthermore serves to master the exothermicity in the main reaction zone. The dilution of the synthesis-gas fresh gas stream and the resulting decrease in the concentration of carbon oxides in the synthesis-gas feed stream reduces the risk of the formation of carbon deposits in the catalyst beds of the main reaction zone and at the exits from the catalyst beds.

Preferred aspects of the invention provide that the conversion of the synthesis-gas feed stream to an intermediate-product gas stream rich in methane in the main reaction zone is effected at temperatures between 200 and 700° C. and at pressures between 15 and 120 bar(a), that the further conversion of the intermediate-product gas stream to a product gas stream rich in methane in the post-reaction zone is effected at temperatures between 150 and 500° C. and at pressures between 30 and 120 bar(a), and that the conversion of the synthesis-gas feed stream in the main reaction zone and/or of the intermediate-product gas stream in the post-reaction zone is effected by means of nickel-, iron- or noble-metal-based methanation catalysts. The use in particular of nickel catalysts for the methanation of carbon oxides with hydrogen is known per se and used on an industrial scale, so that a multitude of suitable catalysts are commercially available.

In accordance with a preferred embodiment of the invention, the molar ratio of hydrogen to carbon monoxide in the synthesis-gas fresh gas stream is between 0.4 and 5.0 mol/mol. In view of the stoichiometry of the above-discussed reactions for the formation of methane by hydrogenation of the carbon oxides, these molar ratios were found to be particularly suitable.

An advantageous aspect of the process according to the invention provides that the main reaction zone comprises at least two catalyst beds, and that a part of the synthesis gas fresh gas stream is guided before the entrance to the second catalyst bed of the main reaction zone. This measure known per se considerably contributes to distributing the high exothermicity of the methanation reaction more uniformly to both catalyst beds, so that a thermal overload of the first catalyst bed, which leads to an accelerated deactivation of the catalyst used there, is avoided.

Preferably, the target pressure in the process according to the invention is between 30 and 120 bar(a), particularly preferably between 30 and 90 bar(a). This corresponds to the operating pressure commonly used in natural gas pipelines.

In accordance with a development of the invention the process of the invention can be used for processing synthesis gas which was produced by gasification of coal. The gasification of coal is followed by the following process steps for conditioning the synthesis gas, which are known per se to the skilled person: A partial conversion of CO to hydrogen for adjusting the required $H_2$/CO ratio (CO shift) as well as a removal of acidic gas constituents, e.g. by washing with cold methanol according to the Rectisol® process, in which sulfur compounds are removed almost completely and carbon dioxide is removed in part. The process according to the invention can, however, also be used for processing synthesis gas from other sources, e.g. from natural gas or by gasification of biomass or synthesis gas containing liquid, hydrocarbonaceous feedstocks.

Further developments, advantages and possible applications of the invention can also be taken from the following description of exemplary embodiments and the drawings. All features described and/or illustrated form the invention per se or in any combination, independent of their inclusion in the claims or their back-reference.

In the exemplary embodiments shown in the Figures, the methanation plant each follows a coal gasification plant not shown in the Figures, in which the synthesis gas determined for the conversion to SNG is produced from feed coal in a manner known per se and is conditioned for use in the methanation plant.

Figure 1:
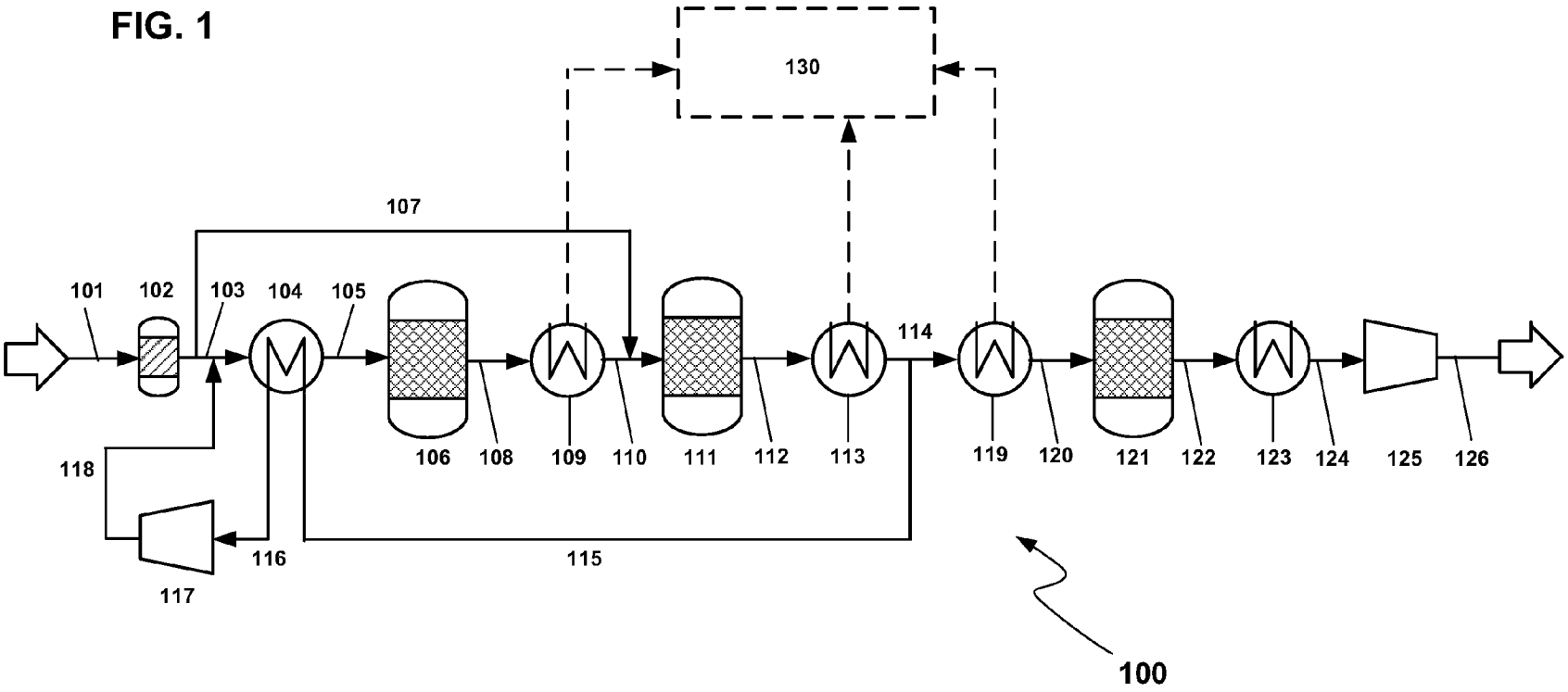
FIG. 1 shows a methanation plant according to the prior art.

FIG. 1 shows a methanation plant 100 according to the prior art. Via conduit 101, synthesis gas produced in the coal gasification plant and subsequently conditioned initially is supplied to a fine desulfurization 102, in order to remove last traces of sulfur compounds from the synthesis-gas fresh gas stream. After passing the fine desulfurization 102, a part of the synthesis-gas fresh gas stream is withdrawn via conduit 107 and guided before the second catalyst bed of the methanation main reaction zone. Via conduit 118, a recirculation stream furthermore is supplied to the fine-desulfurized synthesis-gas fresh gas stream, which already contains synthesis gas partly converted to methane. In this way, a synthesis-gas feed stream is obtained, which via conduit 103 is supplied to a heat exchanger 104 in which the synthesis-gas feed stream is heated up to temperatures between 220 and 350° C. by indirect heat exchange against the hot recirculation stream supplied via conduits 115, 116 and 118. The recirculation stream is conveyed via the cycle compressor 117 and compressed to the methanation pressure of 20 to 50 bar(a).

Via conduit 105, the preheated synthesis-gas feed stream is supplied to the main reaction zone, which consists of two reactors 106 and 111 containing a methanation catalyst. The reactors are adiabatic fixed-bed reactors which are characterized by their constructive simplicity. The use of reactors with a different construction and with a different temperature control would also be conceivable. In the reactor 106 a partial conversion of the carbon oxides with hydrogen is effected on a commercial nickel-based methanation catalyst at temperatures of 220 to 700° C. and pressures between 20 and 50 bar(a). The space velocity is between 2000 and 40,000 $h^{-1}$, the ratio $H_2$/CO lies between 2.5 and 4.0 mol/mol. Via conduit 108, the partly converted intermediate-product gas stream leaving the reactor 106 is supplied to a heat exchanger 109, in which it is cooled to temperatures of 220 and 350° C. Via conduit 110, the cooled intermediate-product gas stream is supplied to the second reactor 111 of the main reaction zone, where a further conversion of the carbon oxides is effected with hydrogen to obtain methane. Before doing so, however, the partial gas stream supplied via conduit 107 is admixed to the intermediate-product gas stream in conduit 110, whereby an additional cooling is effected and the concentration of carbon oxides and hydrogen is increased. In the reactor 111 a further partial conversion of the carbon oxides with hydrogen is effected, wherein the reaction conditions are comparable with those in the reactor 106. Via conduit 112, the intermediate-product gas stream partly converted further, which leaves the reactor 111, is supplied to a cooler 113 in which it is cooled to temperatures of 180 and 350° C. The heat dissipated in the heat exchangers 109, 113 and 119 is utilized for steam generation in the steam generation plant 130.

Via conduit 114, the partly converted intermediate-product gas stream is discharged from the main reaction zone of the methanation plant 100. Via conduit 115, a partial stream is withdrawn therefrom as recirculation stream and guided before the first reactor 106. The partly converted intermediate-product gas stream is cooled to temperatures between 40 and 350° C. in the heat exchanger 119 and via conduit 120 supplied to the reactor 121, which in the present exemplary embodiment represents the only methanation reactor of the post-reaction zone. In the adiabatic or isothermal reactor 121 a further conversion of the carbon oxides with hydrogen to methane is effected on a commercial nickel-based methanation catalyst at temperatures of 180 to 370° C. and pressures between 20 and 50 bar(a). The space velocity is between 2000 and 40.000 $h^{-1}$. The product gas stream rich in methane, which leaves the reactor 121 via conduit 122, is cooled to temperatures of 20 to 120° C. in the cooler 123 and dried in a drying plant not shown in FIG. 1. Via conduit 124, the cooled and dried product gas stream is supplied to the product compressor 125, in which the product gas stream is compressed to the pipeline inlet pressure of 30 to 120 bar(a). Via conduit 126, the compressed product gas stream is supplied to the pipeline not shown in the Figure.

Figure 2:
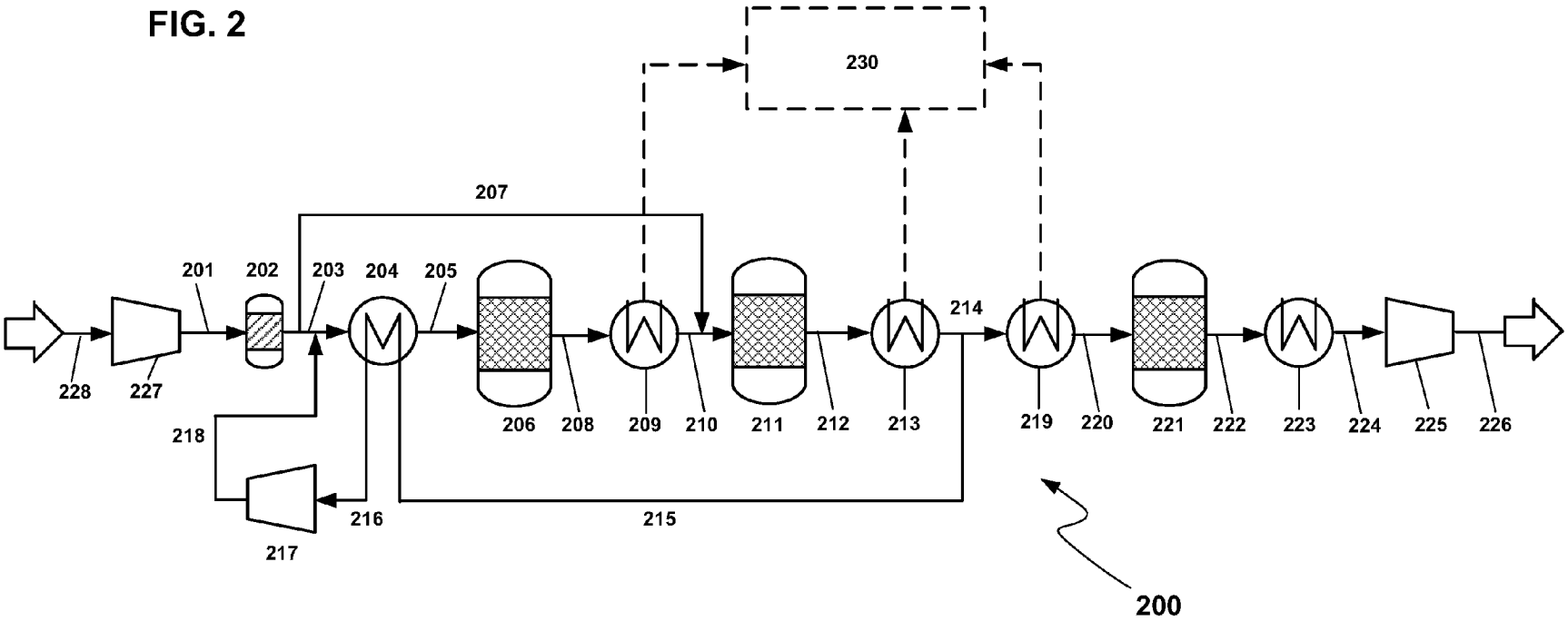
FIG. 2 shows a methanation plant of the invention according to a first embodiment.

FIG. 2 shows a methanation plant 200 of the invention according to a first embodiment. The plant sections each designated with the reference numerals 20*x* and 2*xx*, respectively, correspond to those of the methanation plant according to the prior art as shown in FIG. 1, which have been designated there with 10*x* and 1*xx*, respectively, in terms of their type, configuration, function and operating condition, unless otherwise indicated. In contrast to the methanation plant according to the prior art, the synthesis-gas fresh gas stream is compressed to a pressure of 40 to 120 bar(a) by means of the additional compressor 227 prior to entry into the fine desulfurization 202. In the reactors 206 and 211 a partial conversion of the carbon oxides with hydrogen is effected on a nickel-based methanation catalyst at temperatures of 200 to 700° C. and pressures between 40 and 120 bar(a). The ratio $H_2$/CO lies between 0.4 and 5.0 mol/mol. In the reactor 221 a further conversion of the carbon oxides with hydrogen to methane is effected on a nickel-based methanation catalyst at temperatures of 150 to 500° C. and pressures between 40 and 120 bar(a). The product gas stream rich in methane, which leaves the reactor 221 via conduit 222, is cooled to temperatures of 20 to 120° C. in the cooler 223 and dried in a drying plant not shown in FIG. 2. Via conduit 224, the cooled and dried product gas stream first is supplied to the product compressor 225 and finally via conduit 226 to the pipeline not shown in the Figure.

Figure 3:
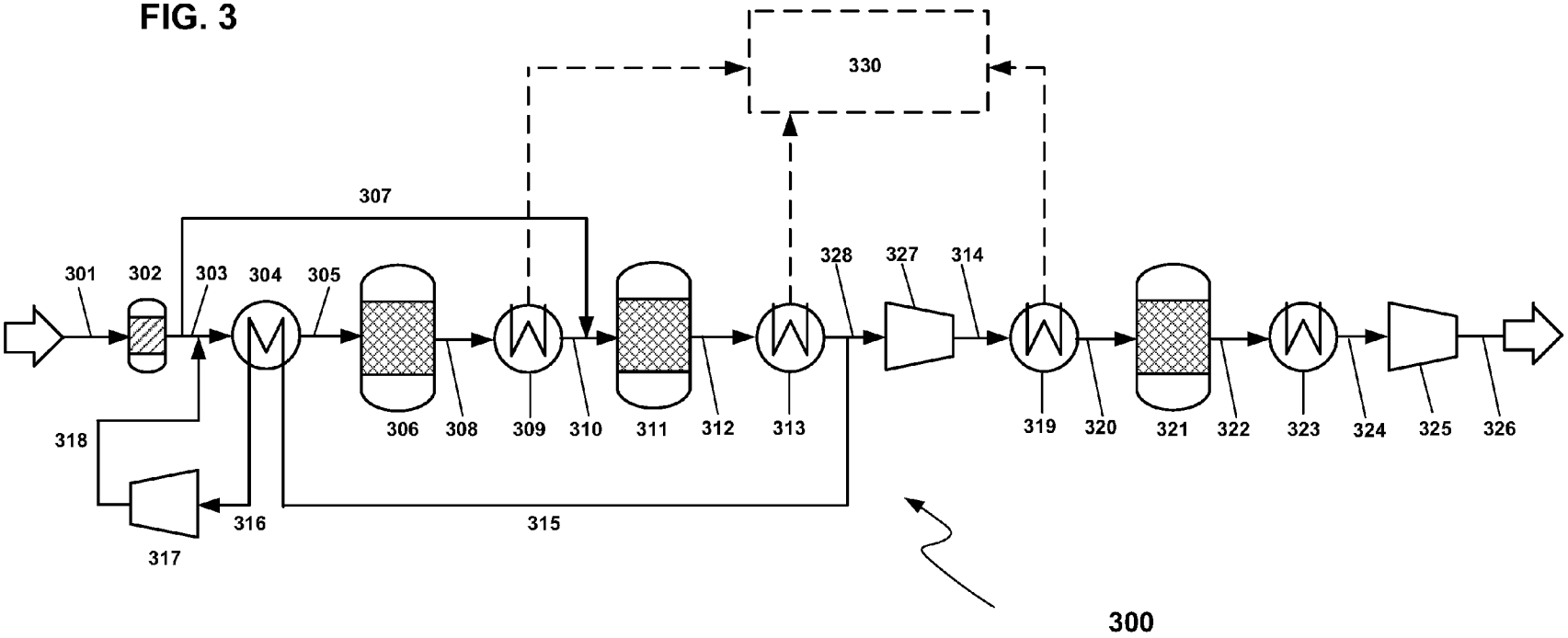
FIG. 3 shows a methanation plant of the invention according to a further embodiment.

FIG. 3 shows a methanation plant 300 of the invention according to a further embodiment. The plant sections each designated with the reference numerals 30*x* and 3*xx*, respectively, again correspond to those of the methanation plant according to the prior art as shown in FIG. 1, which have been designated there with 10*x* and 1*xx*, respectively, in terms of their type, configuration, function and operating condition, unless otherwise indicated. In contrast to the methanation plant according to the prior art, the compression of the partly converted intermediate product gas stream is effected prior to entry into the post-reaction zone by means of an additional compressor 327 to a pressure of 40 to 120 bar(a). In the reactors 306 and 311 a partial conversion of the carbon oxides with hydrogen is effected on a nickel-based methanation catalyst at temperatures of 200 to 700° C. and pressures between 20 and 75 bar(a). The ratio $H_2$/CO lies between 0.4 and 5.0 mol/mol. In the reactor 321 a further conversion of the carbon oxides with hydrogen to methane is effected on a nickel-based methanation catalyst at temperatures of 150 to 500° C. and pressures between 40 and 120 bar(a). The product gas stream rich in methane, which leaves the reactor 321 via conduit 322, is cooled to temperatures of 20 to 120° C. in the cooler 323 and dried in a drying plant not shown in FIG. 3. Via conduit 324, the cooled and dried product gas stream initially is supplied to the product compressor 325 and finally via conduit 326 to the pipeline not shown in the Figure.

EXAMPLES

To illustrate the advantages of the process according to the invention, numerical examples will be given below, in which important operating parameters of a methanation process according to the prior art are compared with the corresponding operating parameters of methanation processes of the invention in accordance with the two embodiments described above. All of the succeeding three cases are based on the following composition of the synthesis-gas fresh gas stream from an entrained-flow gasification of coal.

| Component | Mass flow |
|---|---|
| $H_2$ | 14027 kmol/h |
| CO | 4608 kmol/h |
| $CO_2$ | 47 kmol/h |
| $CH_4$ | 1 kmol/h |
| $N_2$ | 156 kmol/h |
| Ar | 23 kmol/h |

At an outlet pressure of 80.0 bar(a) the product gas rich in methane has the following composition for the three operating cases:

| Case | Compression of the SNG product stream (prior art, FIG. 1, plant 100) | Compression before the post-reaction zone (invention, FIG. 3, plant 300) | Compression before the main reaction zone (invention, FIG. 2, plant 200) |
|---|---|---|---|
| $H_2$ | 117 kmol/h | 82 kmol/h | 33 kmol/h |
| CO | 0.5 kmol/h | 0 kmol/h | 0 kmol/h |
| $CO_2$ | 25 kmol/h | 17 kmol/h | 5 kmol/h |
| $H_2O$ | 40 kmol/h | 16 kmol/h | 16 kmol/h |
| $CH_4$ | 4633 kmol/h | 4641 kmol/h | 4653 kmol/h |
| $N_2$ | 156 kmol/h | 156 kmol/h | 156 kmol/h |
| Ar | 23 kmol/h | 23 kmol/h | 23 kmol/h |

In the following Table, important operating parameters were listed for the three discussed cases, in particular the demands of electric energy, and compared with each other. It can clearly be seen that in particular the aspect of the invention as shown in FIG. 2, which provides a compression to pipeline pressure before the main reaction zone, leads to considerable savings of electric energy.

The invention provides a process for producing synthetic natural gas (SNG) and for providing the same at pipeline operating pressure, which as compared to the processes known in the prior art is characterized by its high energy efficiency. This advantage substantially is achieved by the use of an additional compressor at a suitable point in the process, accompanied by an adaptation of the process parameters. The advantages of the processes known in the prior art as regards their ruggedness and high operational availability still exist.

| Case | Compression of the SNG product stream (prior art, FIG. 1, plant 100) | Compression before the post-reaction zone (invention, FIG. 3, plant 300) | Compression before the main reaction zone (invention, FIG. 2, plant 200) |
|---|---|---|---|
| Additional Compressor | | | |
| Inlet volume flow | | 9702 $m^3/h$ | 18688 $m^3/h$ |
| Inlet molar flow | | 5484 kmol/h | 18866 kmol/h |
| Inlet pressure | | 15.5 bar(a) | 25.8 bar(a) |
| Outlet pressure | | 40.9 bar(a) | 50.8 bar(a) |
| Inlet temperature | | 59.9° C. | 30.0° C. |
| Pressure ratio | | 2.6 | 2.0 |
| Energy demand | | 6.60 MW | 13.88 MW |
| Cycle compressor | | | |
| Inlet volume flow | 145558 $m^3/h$ | 145558 $m^3/h$ | 54752 $m^3/h$ |
| Inlet molar flow | 62029 kmol/h | 62028 kmol/h | 62216 kmol/h |
| Inlet pressure | 15.5 bar(a) | 15.5 bar(a) | 40.9 bar(a) |
| Outlet pressure | 24.2 bar(a) | 24.2 bar(a) | 49.7 bar(a) |
| Pressure ratio | 1.6 | 1.6 | 1.2 |
| Inlet temperature | 174.9° C. | 174.9° C. | 174.8° C. |
| Energy demand | 39.75 MW | 39.75 MW | 16.55 MW |
| Product compressor | | | |
| Inlet volume flow | 16133 $m^3/h$ | 3461 $m^3/h$ | 3461 $m^3/h$ |
| Inlet molar flow | 4994 kmol/h | 4885 kmol/h | 4885 kmol/h |
| Inlet pressure | 8.0 bar(a) | 35.5 bar(a) | 35.5 bar(a) |
| Outlet pressure | 80.0 bar(a) | 80.0 bar(a) | 80.0 bar(a) |
| Inlet temperature | 41.6° C. | 42.5° C. | 42.5° C. |
| Number of stages | 3 | 2 | 2 |
| Pressure ratio | 10.0 | 2.3 | 2.3 |
| Energy demand | 14.03 MW | 4.41 MW | 4.41 MW |
| Total energy demand | 53.78 MW | 50.76 MW | 34.84 MW |

| List of reference numerals | |
|---|---|
| 101, 201, 301 | Pipe |
| 102, 202, 302 | Desulfurization reactor |
| 103, 203, 303 | Pipe |
| 104, 204, 304 | Heat exchanger |
| 105, 205, 305 | Pipe |
| 106, 206, 306 | Methanation reactor |
| 107, 207, 307 | Pipe |
| 108, 208, 308 | Pipe |
| 109, 209, 309 | Heat exchanger |
| 110, 210, 310 | Pipe |
| 111, 211, 311 | Methanation reactor |
| 112, 212, 312 | Pipe |
| 113, 213, 313 | Heat exchanger |
| 114, 214, 314 | Pipe |
| 115, 215, 315 | Pipe |
| 116, 216, 316 | Pipe |
| 117, 217, 317 | Cycle compressor |
| 118, 218, 318 | Pipe |
| 119, 219, 319 | Heat exchanger |
| 120, 220, 320 | Pipe |
| 121, 221, 321 | Methanation reactor |
| 122, 222, 322 | Pipe |
| 123, 223, 323 | Heat exchanger |
| 124, 224, 324 | Pipe |

-continued

| List of reference numerals | |
|---|---|
| 125, 225, 325 | Product compressor |
| 126, 226, 326 | Pipe |
| 227, 327 | Additional compressor |
| 228, 328 | Pipe |
| 130, 230, 330 | Steam generation unit |

The invention claimed is:

1. A process for producing a product gas stream rich in methane with a defined target pressure from a synthesis-gas fresh gas stream containing carbon oxides and hydrogen, comprising the following process steps:

(a) providing a synthesis-gas fresh stream at an inlet pressure, (b) combining the synthesis-gas fresh gas stream with a recirculation stream to obtain a synthesis-gas feed stream, (c) heating up the synthesis-gas feed stream and supplying the same to a main reaction zone, (d) converting the heated synthesis-gas feed stream to an intermediate-product gas stream enriched in methane in a main reaction zone under methanation conditions, wherein the main reaction zone includes at least one catalyst bed containing a methanation catalyst, (e) withdrawing a partial stream of the intermediate-product gas stream rich in methane after the main reaction zone as recirculation stream, wherein the recirculation stream is recirculated before the main reaction zone by means of a cycle compressor and is combined with the synthesis-gas fresh gas stream to obtain the synthesis-gas feed stream, (f) supplying the fraction of the intermediate-product gas stream rich in methane remaining after step (e) to a post-reaction zone, (g) converting the intermediate-product gas stream supplied to the post-reaction zone under methanation conditions to a product gas stream rich in methane, wherein the post-reaction zone includes at least one catalyst bed containing a methanation catalyst, (h) withdrawing the product gas stream rich in methane from the post-reaction zone and adjusting the target pressure by means of a product compressor, wherein an additional compressor is provided upstream of the main reaction zone and/or the post reaction zone.

2. The process according to claim 1, wherein the compression is effected by means of an additional compressor before the main reaction zone and before combining the synthesis-gas fresh gas stream with the recirculation stream.

3. The process according to claim 1, wherein the compression by means of an additional compressor is effected before the last catalyst bed of the post-reaction zone and after withdrawing the recirculation stream after the main reaction zone.

4. The process according to claim 1, wherein heating up the synthesis-gas feed stream supplied to the main reaction zone is effected by indirect heat exchange against a hot fluid stream inherent or foreign to the process.

5. The process according to claim 1, wherein the conversion of the synthesis-gas feed stream to an intermediate-product gas stream rich in methane in the main reaction zone is effected at temperatures between 200 and 700° C. and at pressures between 15 and 120 bar(a) in the presence of a methanation catalyst.

6. The process according to claim 1, wherein the conversion of the intermediate product gas stream to a product gas stream rich in methane in the post-reaction zone is effected at temperatures between 150 and 500° C. and at pressures between 30 and 120 bar(a) in the presence of a methanation catalyst.

7. The process according to claim 1, wherein the mass flow ratio of hydrogen to carbon monoxide in the synthesis-gas fresh gas stream is between 0.4 and 5.0 mol/mol.

8. The process according to claim 1, wherein the main reaction zone comprises at least two catalyst beds.

9. The process according to claim 8, wherein a part of the synthesis-gas fresh gas stream is guided before the entrance to the second catalyst bed of the main reaction zone.

10. The process according to claim 1, wherein the target pressure is between 30 and 120 bar(a).

* * * * *